US011069293B2

(12) United States Patent
Ishii et al.

(10) Patent No.: US 11,069,293 B2
(45) Date of Patent: Jul. 20, 2021

(54) LUMINANCE CONTROLLING UNIT, LIGHT-EMITTING UNIT, AND LUMINANCE CONTROLLING METHOD

(71) Applicant: JOLED Inc., Tokyo (JP)

(72) Inventors: Hiroaki Ishii, Tokyo (JP); Teppei Isobe, Tokyo (JP)

(73) Assignee: JOLED Inc., Tokyo (JP)

( * ) Notice: Subject to any disclaimer, the term of this patent is extended or adjusted under 35 U.S.C. 154(b) by 115 days.

(21) Appl. No.: 16/048,828

(22) Filed: Jul. 30, 2018

(65) Prior Publication Data

US 2019/0066593 A1 Feb. 28, 2019

(30) Foreign Application Priority Data

Aug. 22, 2017 (JP) ..... JP2017-159014

(51) Int. Cl.
*G09G 3/3258* (2016.01)
*G09G 3/3233* (2016.01)

(52) U.S. Cl.
CPC ..... *G09G 3/3258* (2013.01); *G09G 3/3233* (2013.01); *G09G 2300/0819* (2013.01); *G09G 2300/0842* (2013.01); *G09G 2300/0861* (2013.01); *G09G 2320/064* (2013.01); *G09G 2330/021* (2013.01); *G09G 2330/023* (2013.01)

(58) Field of Classification Search
CPC ... G09G 2300/0819; G09G 2300/0842; G09G 3/3233; G09G 2320/064; G09G 2320/0633
See application file for complete search history.

(56) References Cited

U.S. PATENT DOCUMENTS 10,825,377 B2 * 11/2020 Lee ..... G09G 3/32
2004/0012545 A1 * 1/2004 Li ..... G09G 3/3233 345/55
2012/0223649 A1 * 9/2012 Saes ..... H05B 45/37 315/186
2015/0187277 A1 7/2015 Maeyama et al.
(Continued)

FOREIGN PATENT DOCUMENTS

JP 2008-026762 A 2/2008
JP 2015-125356 A 7/2015
JP 2016-99468 A 5/2016

OTHER PUBLICATIONS

Japan Office Action dated Jun. 30, 2020, corresponding to Application No. 2017-159014.

*Primary Examiner* — William Boddie
*Assistant Examiner* — Bipin Gyawali
(74) *Attorney, Agent, or Firm* — Michael Best & Friedrich LLP

(57) ABSTRACT

A luminance controlling unit includes a luminance controller that controls luminance of a pixel array including pixels each including a current-driven self-luminescent element. The luminance controller performs, on the basis of an image signal, a dynamic control of a duty ratio of a voltage pulse and a potential difference between a first voltage and a second voltage. The first voltage is outputted from a first voltage source adjacent to an anode of the corresponding self-luminescent element, and the second voltage is outputted from a second voltage source adjacent to a cathode of the corresponding self-luminescent element. The duty ratio is directed to controlling of light emission and light extinction of the self-luminescent element.

18 Claims, 6 Drawing Sheets

(56) References Cited

U.S. PATENT DOCUMENTS

| | | | | |
|---|---|---|---|---|
| 2016/0148576 | A1 | 5/2016 | Kato | |
| 2016/0180815 | A1* | 6/2016 | Pyo | G09G 3/2022 345/213 |
| 2016/0314761 | A1* | 10/2016 | Kim | G09G 5/10 |
| 2018/0240398 | A1* | 8/2018 | Machida | H01L 33/00 |

* cited by examiner

LUMINANCE CONTROLLING UNIT, LIGHT-EMITTING UNIT, AND LUMINANCE CONTROLLING METHOD

CROSS REFERENCE TO RELATED APPLICATIONS

This application claims the benefit of Japanese Priority Patent Application No. 2017-159014 filed on Aug. 22, 2017, the entire contents of which are incorporated herein by reference.

BACKGROUND

The disclosure relates to a luminance controlling unit, a light-emitting unit, and a luminance controlling method.

Recently, a display unit that includes a current-driven optical element, such as an organic electroluminescent element, in each pixel has been developed for commercialization in the technical field of an image display unit. The current-driven optical element changes its luminance depending on the magnitude of a current flowing therein. Reference is made to Japanese Unexamined Patent Application Publication No. 2016-99468, for example.

SUMMARY

Reducing the magnitude of a current in a display unit to suppress an increase in electric power consumption may possibly decrease luminance of the display unit. A larger decrease in the luminance may possibly cause adverse effects on display quality.

It is desirable to provide a luminance controlling unit, a light-emitting unit, and a luminance controlling method that are able to mitigate or prevent a decrease in luminance while suppressing an increase in electric power consumption.

A luminance controlling unit according to one embodiment of the disclosure includes a luminance controller that controls luminance of a pixel array. The pixel array includes pixels each including a current-driven self-luminescent element. The luminance controller performs, on the basis of an image signal, a dynamic control of a duty ratio of a voltage pulse and a potential difference between a first voltage and a second voltage. The first voltage is outputted from a first voltage source adjacent to an anode of the corresponding self-luminescent element, and the second voltage is outputted from a second voltage source adjacent to a cathode of the corresponding self-luminescent element. The duty ratio is directed to controlling of light emission and light extinction of the self-luminescent element.

A light-emitting unit according to one embodiment of the disclosure includes a pixel array and a luminance controller that controls luminance of the pixel array. The pixel array includes pixels each including a current-driven self-luminescent element. The luminance controller performs, on the basis of an image signal, a dynamic control of a duty ratio of a voltage pulse and a potential difference between a first voltage and a second voltage. The first voltage is outputted from a first voltage source adjacent to an anode of the corresponding self-luminescent element, and the second voltage is outputted from a second voltage source adjacent to a cathode of the corresponding self-luminescent element. The duty ratio is directed to controlling of light emission and light extinction of the self-luminescent element.

A luminance controlling method according to one embodiment of the disclosure includes controlling luminance of a pixel array that includes pixels each including a current-driven self-luminescent element, and dynamically controlling a duty ratio of a voltage pulse and a potential difference between a first voltage and a second voltage on the basis of an image signal. The first voltage is outputted from a first voltage source adjacent to an anode of the corresponding self-luminescent element, and the second voltage is outputted from a second voltage source adjacent to a cathode of the corresponding self-luminescent element. The duty ratio is directed to controlling light emission and light extinction of the self-luminescent element.

BRIEF DESCRIPTION OF THE DRAWINGS

The accompanying drawings are included to provide a further understanding of the disclosure and are incorporated in and constitute a part of this specification. The drawings illustrate example embodiments and, together with the specification, serve to explain the principles of the disclosure.

DETAILED DESCRIPTION

Figure 1:
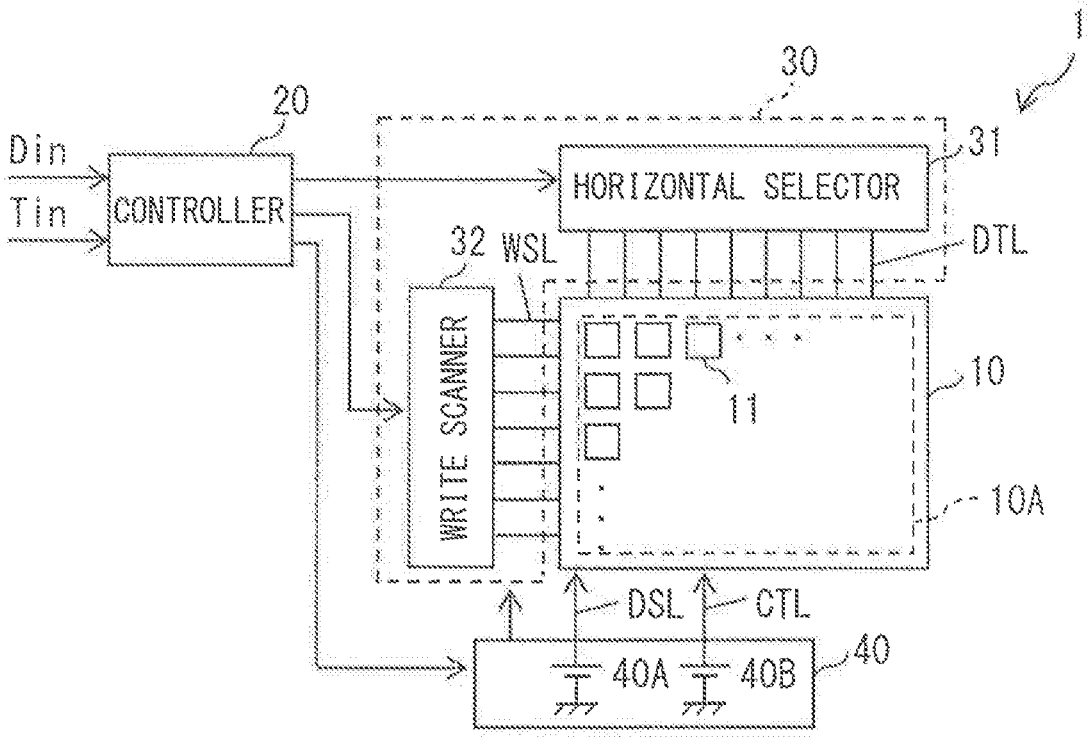
FIG. 1 schematically illustrates an exemplary configuration of a display unit according to one embodiment of the disclosure.

In the following, some example embodiments of the disclosure are described in detail, in the following order, with reference to the accompanying drawings. Note that the following description is directed to illustrative examples of the disclosure and not to be construed as limiting to the disclosure. Factors including, without limitation, numerical values, shapes, materials, components, positions of the components, and how the components are coupled to each other are illustrative only and not to be construed as limiting to the disclosure. Further, elements in the following example embodiments which are not recited in a most-generic independent claim of the disclosure are optional and may be provided on an as-needed basis. The drawings are schematic and are not intended to be drawn to scale. Note that the like elements are denoted with the same reference numerals, and any redundant description thereof will not be described in detail. Note that the description is given in the following order.

1. Embodiments
2. Modification Examples

1. Embodiments

Configuration

Figure 2:
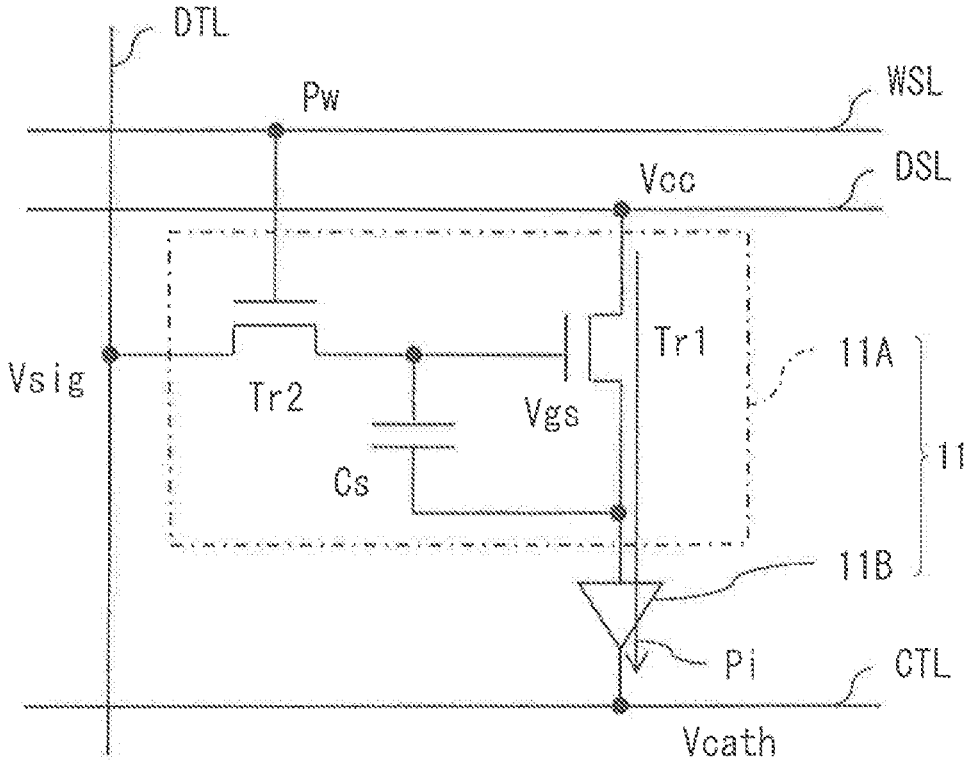
FIG. 2 illustrates an exemplary circuit configuration of each pixel according to one embodiment of the disclosure.

FIG. 1 schematically illustrates an exemplary configuration of a display unit 1 according to an exemplary embodiment of the disclosure. FIG. 2 illustrates an exemplary circuit configuration of each pixel 11 in the display unit 1. The display unit 1 may include, for example, a display panel 10, a controller 20, a driver 30, and a power supply circuit 40. The display unit 1 may correspond to a specific but non-limiting example of a "light-emitting unit" according to one embodiment of the disclosure. The controller 20 may correspond to a specific but non-limiting example of a "luminance controller" according to one embodiment of the disclosure. The driver 30 may be mounted on an outer edge of the display panel 10, for example. The controller 20 and the power supply circuit 40 may be mounted on a substrate that is coupled to the display panel 10 via flexible printed circuits (FPCs), for example. The display panel 10 may include a pixel array 10A including multiple pixels 11 arranged in matrix. The controller 20 and the driver 30 may drive the display panel 10 (i.e., pixels 11) on the basis of an external image signal Din and an external synchronizing signal Tin. The power supply circuit 40 may supply a predetermined voltage to the driver 30 and the display panel 10.

Display Panel 10

In response to the active-matrix driving of the pixels 11 performed by the controller 20 and the driver 30, the display panel 10 may display an image based on the external image signal Din and the external synchronizing signal Tin. The display panel 10 may include multiple scanning lines WSL extending in a row direction, multiple signal lines DTL extending in a column direction, multiple power lines DSL, multiple cathode lines CTL, and the multiple pixels 11 arranged in matrix. In place of the multiple cathode lines CTL, a cathode sheet may be provided over the pixel array 10A. Note that the term "cathode lines CTL" may be used interchangeably with the term "cathode sheet" in the following description.

The scanning lines WSL may be used to select the pixels 11. For example, a selection pulse Pw may be supplied through the scanning lines WSL to the pixels 11 to select the pixels 11 on a predetermined unit basis, for example, a pixel-row basis. A signal voltage Vsig based on the image signal Din may be supplied through the signal lines DTL to the pixels 11. The signal lines DTL may be each coupled to an output end of a horizontal selector 31 described below. Each of the signal lines DTL may be assigned to a corresponding pixel column, for example. The scanning lines WSL may be each coupled to an output end of a write scanner 32 described below. Each of the scanning lines WSL may be assigned to a corresponding pixel row, for example.

A power voltage Vcc outputted from the power supply circuit 40 may be supplied through the power lines DSL to the pixels 11 (i.e., organic electroluminescent elements 11B described below). The power voltage Vcc may correspond to a specific but non-limiting example of a "first voltage" according to one embodiment of the disclosure. A cathode voltage Vcath outputted from the power supply circuit 40 may be supplied through the cathode lines CTL to the pixels 11 (i.e., organic electroluminescent elements 11B described below). The cathode voltage Vcath may correspond to a specific but non-limiting example of a "second voltage" according to one embodiment of the disclosure. The power lines DSL and the cathode lines CTL may be each coupled to an output end of the power supply circuit 40.

The pixels 11 on the pixel array 10A may include ones emitting red light, ones emitting green light, and ones emitting blue light, for example. The pixels 11 may further include ones emitting light in another color, such as white or yellow, for example.

The pixels 11 each include, for example, a pixel circuit 11A and an organic electroluminescent element 11B. The organic electroluminescent element 11B is a current-driven self-luminescent element.

The pixel circuit 11A may control light emission and light extinction of the organic electroluminescent element 11B. The pixel circuit 11A may hold a voltage written into the corresponding pixel 11 through write scanning described below. The pixel circuit 11A may include, for example, a driving transistor Tr1, a switching transistor Tr2, and a storage capacitor Cs.

The switching transistor Tr2 may control application of the signal voltage Vsig to a gate of the driving transistor Tr1. The signal voltage Vsig may be based on the image signal Din or Dout. For example, the switching transistor Tr2 may sample a voltage of the signal line DTL and write the sampled voltage into the gate of the driving transistor Tr1. Through the sampling of the signal voltage Vsig of the signal line DTL, the switching transistor Tr2 may generate a data pulse of which peak value is the signal voltage Vsig, and apply the data pulse to the gate of the driving transistor Tr1.

The driving transistor Tr1 may be coupled in series to the organic electroluminescent element 11B. The driving transistor Tr1 may drive the organic electroluminescent element 11B. The driving transistor Tr1 may control a driving current flowing in the organic electroluminescent element 11B on the basis of the magnitude of the voltage sampled at the switching transistor Tr2.

The storage capacitor Cs may hold a predetermined voltage between the gate and a source of the driving transistor Tr1. The storage capacitor Cs may hold a gate-source voltage Vgs of the driving transistor Tr1 at a constant level for a predetermined period. Note that the pixel circuit 11A may have a circuit configuration that includes the 2Tr1C circuit described above and additional capacitors and transistors. Alternatively, the pixel circuit 11A may have a circuit configuration different from that of the 2Tr1C circuit described above.

Each of the signal lines DTL may be coupled to an output end of the horizontal selector 31 described below and a source or drain of the switching transistor Tr2. Each of the scanning lines WSL may be coupled to an output end of the write scanner 32 described below and a gate of the switching transistor Tr2. Each of the power lines DSL may be coupled to an output end of a power supply circuit 40 and the source or drain of the driving transistor Tr1. Each of the cathode lines CTL may be coupled to the output end of the power supply circuit 40 and a cathode of the organic electroluminescent element 11B.

The gate of the switching transistor Tr2 may be coupled to the corresponding scanning line WSL. One of the source or drain of the switching transistor Tr2 may be coupled to the corresponding signal line DTL. The other of the source or drain, of the switching transistor Tr2, that is not coupled to the signal line DTL may be coupled to the gate of the driving transistor Tr1. One of the source or drain of the driving transistor Tr1 may be coupled to the corresponding power line DSL. The other of the source or drain, of the driving transistor Tr1, that is not coupled to the power line DSL may be coupled to an anode of the organic electroluminescent element 11B. One end of the storage capacitor Cs may be coupled to the gate of the driving transistor Tr1. The other end of the storage capacitor Cs may be coupled to one of the source or drain, of the driving transistor Tr1, that is adjacent to the organic electroluminescent element 11B. The cathode of the organic electroluminescent element 11B may be coupled to the corresponding cathode line CTL.

Driver 30

The driver 30 may include the horizontal selector 31 and the write scanner 32, for example. The horizontal selector 31 may apply an analog signal voltage (Vsig×G) to each of the signal lines DTL, in response to a control signal from the controller 20, for example. The symbol G represents a gain for adjustment of a luminance level. The write scanner 32 may apply the analog selection pulse Pw to each of the scanning lines WSL, in response to a control signal from the controller 20, for example. The horizontal selector 31 and the write scanner 32 may apply the signal voltage (Vsig×G) through the signal line DTL to the source or drain of the switching transistor Tr2, and apply the selection pulse Pw through the scanning line WSL to the gate of the switching transistor Tr2. The data pulse of which peak value is the signal voltage (Vsig×G) may be thereby written into the gate of the driving transistor Tr1.

Power Supply Circuit 40

The power supply circuit 40 may apply the power voltage Vcc and the cathode voltage Vcath to each pixel. The power supply circuit 40 may apply a potential difference ΔV (=Vcc−Vcath) to each pixel. In an exemplary embodiment, the power supply circuit 40 may supply the potential difference ΔV (=Vcc−Vcath) to a current path Pi including the driving transistor Tr1 and the organic electroluminescent element 11B in each pixel. The power supply circuit 40 may include, for example, voltage sources 40A and 40B. The voltage source 40A may output the power voltage Vcc to the power line DSL. The voltage source 40A may correspond to a specific but non-limiting example of a "first voltage source" according to one embodiment of the disclosure. The voltage source 40B may output the voltage Vcath to the cathode line CTL. The voltage source 40B may correspond to a specific but non-limiting example of a "second voltage source" according to one embodiment of the disclosure. The voltage source 40A, 40B, or both may be configured to supply a voltage depending on the control signal received from the controller 20. In an exemplary embodiment, the voltage source 40A may output, to the power line DSL, an analog voltage pulse Pd that has a duty ratio Dact (=Dref×R) and of which peak value is the power voltage Vcc_act, in response to the control signal from the controller 20. The power voltage Vcc_act may be less than a default power voltage Vcc_ref. The default power voltage Vcc_ref may be equal to the power voltage Vcc in a condition where a duty ratio D is not controlled. The duty ratio Dact may be greater than a default duty ratio Dref. The default duty ratio Dref may be equal to the duty ratio D in a condition where the duty ratio D is not controlled. The symbol R represents a compensation factor that is directed to correction of the duty ratio. The compensation factor R may be represented by (Vcc_ref−Vcath)/(Vcc_act−Vcath), for example.

Controller 20

Figure 3:
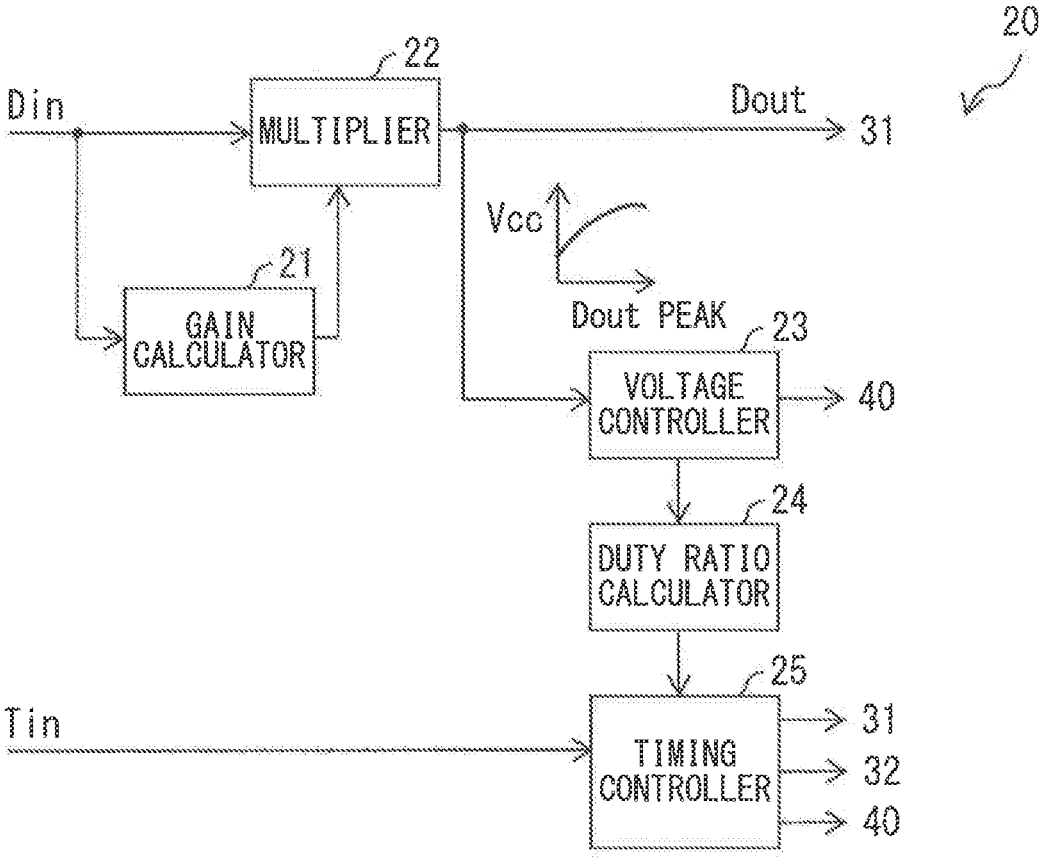
FIG. 3 is an exemplary block diagram illustrating an operation of a controller according to one embodiment of the disclosure.
Figure 4:
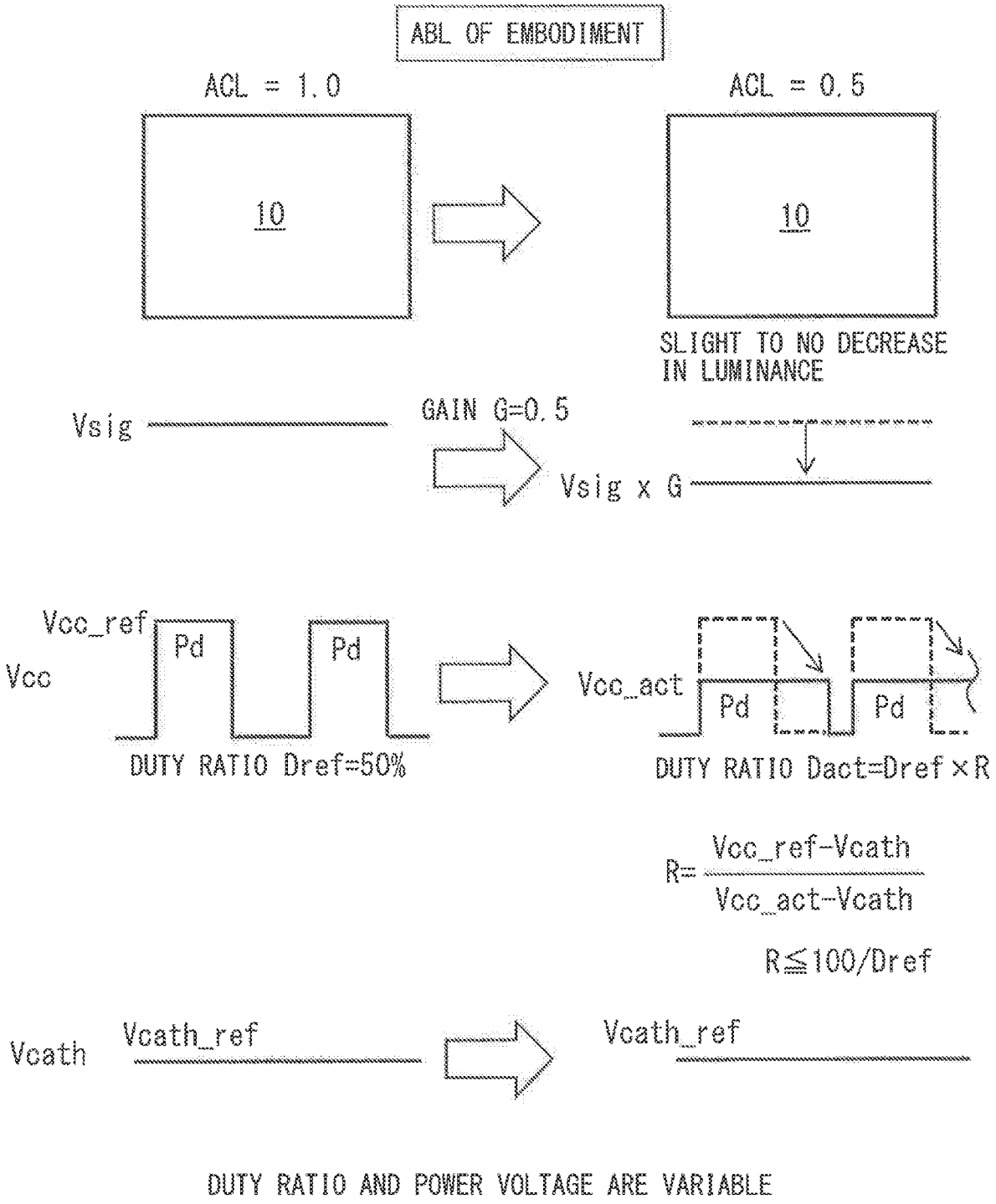
FIG. 4 illustrates exemplary signal processing performed at the controller according to one embodiment of the disclosure.

The controller 20 will now be described. FIG. 3 is an exemplary block diagram illustrating an operation of the controller 20. FIG. 4 illustrates exemplary signal processing performed at the controller 20. The controller 20 controls luminance of the pixel array 10A. The controller 20 controls the luminance of the pixel array 10A by performing a dynamic control of the duty ratio D of the voltage pulse Pd and the potential difference ΔV (=Vcc−Vcath) on the basis of the image signal Din. During the luminance control on the pixel array 10A, the controller 20 may perform an automatic brightness limiting (ABL) operation that limits the driving current. The ABL operation may limit the driving current by correcting the image signal Din to cause the signal voltage Vsig to be less than the signal voltage based on the image signal Din. The controller 20 may include, for example, a gain calculator 21, a multiplier 22, a voltage controller 23, a duty ratio calculator 24, and a timing controller 25. The ABL operation may be performed at the gain calculator 21 and the multiplier 22, for example.

The gain calculator 21 may calculate an average current level (ACL) on the basis of an average luminance level or an average image signal level of the received digital image signal Din, for example. The gain calculator 21 may also calculate a gain G on the basis of the calculated ACL, for example. The gain calculator 21 may hold a limit value based on the ACL in a memory therein, for example. The gain calculator 21 may compare the limit value read from the memory and the calculated ACL to calculate a gain G. In a case where the calculated ACL exceeds the limit value, the gain calculator 21 may calculate the gain G that causes the calculated ACL to decrease to the limit value. The gain calculator 21 may output the calculated ACL to the multiplier 22, for example.

The multiplier 22 may multiply the image signal Din by the gain G received from the gain calculator 21 and thereby generate an image signal Dout, which has been subjected to the ABL operation. The multiplier 22 may output the generated image signal Dout to the horizontal selector 31 and the voltage controller 23.

The voltage controller 23 controls the potential difference ΔV (=Vcc−Vcath), the power voltage Vcc, or the cathode voltage Vcath, on the basis of the image signal Dout. In an exemplary embodiment, the voltage controller 23 may control the potential difference ΔV, the power voltage Vcc, or the cathode voltage Vcath by controlling the output from the voltage source 40A or the voltage source 40B or both. The voltage controller 23 may cause the potential difference ΔV to be less than a default or predetermined potential difference ΔVref on the basis of the image signal Dout, for example. For example, the voltage controller 23 may detect a peak value of the image signal Dout in a frame image, and calculates the potential difference ΔV based on the detected peak value. The voltage controller 23 may hold a mathematical function or table describing a correlation between a peak value of the image signal Dout and a potential difference ΔV, and calculate the potential difference ΔV based on the peak value on the basis of the mathematical function or table. The voltage controller 23 may output, to the duty ratio calculator 24, data on the calculated potential difference ΔV. The voltage controller 23 may also output, to the power supply circuit 40, a control signal directed to generation of the calculated potential difference ΔV.

In another embodiment where the voltage controller 23 performs the control based on the image signal Dout only on the voltage source 40A, the voltage controller 23 may calculate the power voltage Vcc based on the detected peak value. In this embodiment, the voltage controller 23 may hold the mathematical function or table describing a correlation between a peak value of the image signal Dout and a power voltage Vcc, for example, and calculate the power voltage Vcc based on the peak voltage on the basis of the mathematical function or table. The voltage controller 23 may output, to the duty ratio calculator 24, the data on the calculated power voltage Vcc. The voltage controller 23 may also output, to the power supply circuit 40, a control signal directed to generation of the calculated power voltage Vcc.

In still another embodiment where the voltage controller 23 performs the control based on the image signal Dout only on the voltage source 40B, the voltage controller 23 may calculate the cathode voltage Vcath based on the detected peak value. In this embodiment, the voltage controller 23 may hold the mathematical function or table describing a correlation between a peak value of the image signal Dout and a cathode voltage Vcath, for example, and calculate the cathode voltage Vcath based on the peak value on the basis of the mathematical function or table. The voltage controller 23 may output, to the duty ratio calculator 24, the data on the calculated cathode voltage Vcath. The voltage controller 23 may also output, to the power supply circuit 40, a control signal directed to generation of the calculated cathode voltage Vcath.

On the basis of the signal or the data on the potential difference ΔV, the power voltage Vcc, or the cathode voltage Vcath, received from the voltage controller 23, the duty ratio calculator 24 performs the dynamic control of the duty ratio D of the voltage pulse Pd. For example, the duty ratio calculator 24 may cause the duty ratio D to be greater than the default duty ratio Dref, on the basis of the signal or the data on the potential difference ΔV, the power voltage Vcc, or the cathode voltage Vcath, received from the voltage controller 23. In an exemplary embodiment, the duty ratio calculator 24 may control the duty ratio D within a range in which a power consumption per frame image on the display panel 10 does not exceed a reference power consumption per frame image on the display panel 10 at the default duty ratio Dref. For example, the duty ratio calculator 24 may output, to the timing controller 25, data on the duty ratio Dact calculated on the basis of the signal or the data on the potential difference ΔV, the power voltage Vcc, or the cathode voltage Vcath, received from the voltage controller 23.

The duty ratio calculator 24 may control the duty ratio D within a range in which the power consumption per frame image on the display panel 10 does not exceed a reference power consumption. The reference power consumption is a power consumption in a condition where the ABL operation is not performed or the gain G is set to 1.0, for example.

In an exemplary embodiment where the controller 20 performs the ABL operation and the voltage controller 23 performs the voltage control based on the image signal Dout only on the voltage source 40A, the duty ratio calculator 24 may calculate, as illustrated in FIG. 4, a new duty ratio Dact using the following expressions:

$$Dact=Dref\times R \quad \text{Expression (1)}$$

$$R=(Vcc_ref-Vcath)/(Vcc_act-Vcath) \quad \text{Expression (2)}$$

where Dact represents a corrected duty ratio D of the voltage pulse Pd in a condition where the voltage control based on the mage signal Dout is performed only on the voltage source 40A, Dref represents a default duty ratio of the voltage pulse Pd in a condition where the voltage control based on the image signal Dout is not performed on the voltage sources 40A and 40B, R represents the compensation factor that is directed to correction of the duty ratio, Vcc_ref represents a default output voltage of the voltage source 40A in a condition where the voltage control based on the image signal Dout is not performed on the voltage sources 40A and 40B, and Vcc_act represents a corrected output voltage of the voltage source 40A in a condition where the voltage control based on the image signal Dout is performed only on the voltage source 40A.

In an exemplary embodiment where the controller 20 may perform the ABL operation and the voltage controller 23 may perform the voltage control based on the image signal Dout only on the voltage source 40B, the duty ratio calculator 24 may calculate a new duty ratio Dact using the following expressions:

$$Dact=Dref\times R \quad \text{Expression (1)}$$

$$R=(Vcc-Vcath_ref)/(Vcc-Vcath_act) \quad \text{Expression (3)}$$

where Dact represents a corrected duty ratio D of the voltage pulse Pd in a condition where the voltage control based on the image signal Dout is performed only on the voltage source 40B, Dref represents a default duty ratio of the voltage pulse Pd in a condition where the voltage control based on the image signal Dout is not performed on the voltage sources 40A and 40B, R represents a compensation factor that is directed to correction of the duty ratio, Vcath_ref represents a default output voltage of the voltage source 40B in a condition where the voltage control based on the image signal Dout is not performed on the voltage sources 40A and 40B, and Vcath_act represents a corrected output voltage of the voltage source 40B in a condition where the voltage control based on the image signal Dout is performed only on the voltage source 40B.

In an exemplary embodiment where the controller 20 may perform the ABL operation and the voltage controller 23 may perform the voltage control based on the image signal Dout on both the voltage sources 40A and 40B, the duty ratio calculator 24 may calculate a new duty ratio Dact using the following expressions:

$$Dact=Dref\times R \quad \text{Expression (1)}$$

$$R=(Vcc_ref-Vcath_ref)/(Vcc_act-Vcath_act) \quad \text{Expression (4)}$$

where Dact represents a corrected duty ratio D of the voltage pulse Pd in a condition where the voltage control based on the image signal Dout is performed on the voltage sources 40A and 40B, Dref represents a default duty ratio of the voltage pulse Pd in a condition where the voltage control based on the image signal Dout is not performed on the voltage sources 40A and 40B, R represents a compensation factor that is directed to correction of the duty ratio, Vcc_ref represents a default output voltage of the voltage source 40A in a condition where the voltage control based on the image signal Dout is not performed on the voltage sources 40A and 40B, Vcc_act represents a corrected output voltage of the voltage source 40A in a condition where the voltage control based on the image signal Dout is performed on the voltage sources 40A and 40B, Vcath_ref represents a default output voltage of the voltage source 40B in a condition where the voltage control based on the image signal Dout is not performed on the voltage sources 40A and 40B, and Vcath_act represents a corrected output voltage of the voltage source 40B in a condition where the voltage control based on the image signal Dout is performed on the voltage sources 40A and 40B.

Figure 5:
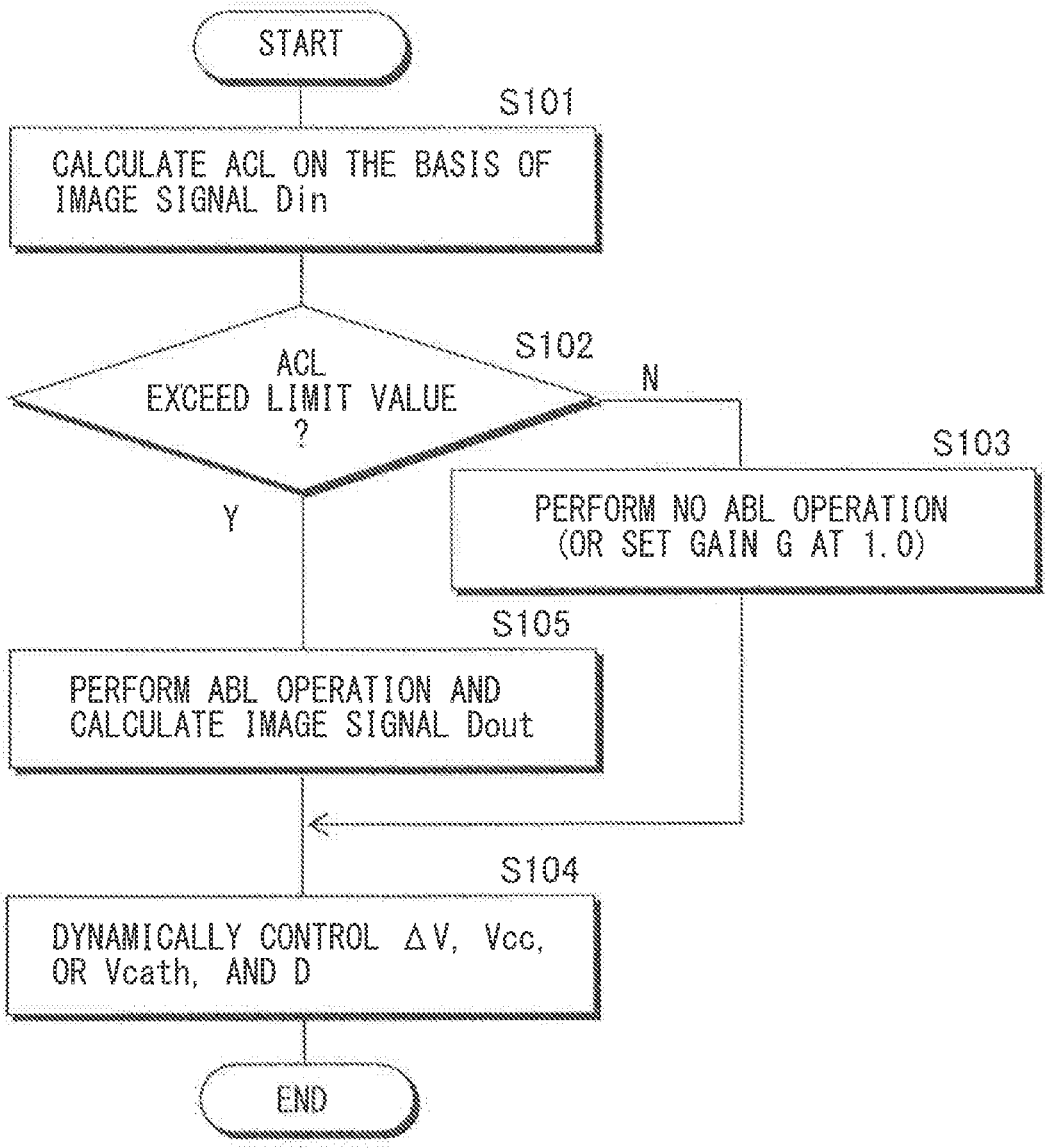
FIG. 5 is an exemplary flow chart illustrating a procedure performed at the controller for controlling an output voltage on the basis of an image signal according to one embodiment of the disclosure.

The output-voltage control based on the image signal Dout performed on the power supply circuit 40 will now be described in detail. FIG. 5 is an exemplary flow chart illustrating a procedure for controlling the output voltage from the power supply circuit 40 on the basis of the image signal Dout.

The procedure may start with calculating the ACL at the gain calculator 21 and the multiplier 22 in the controller 20 on the basis of the image signal Din (Step S101). The controller 20 may thereafter determine if the ACL exceeds the limit value (Step S102). In a case where the ACL falls below the limit value, the controller 20 may perform no ABL operation or set the gain G to 1.0 (Step S103). The controller 20 thereafter dynamically controls the potential difference ΔV, the power voltage Vcc, or the cathode voltage Vcath, and the duty ratio D of the voltage pulse Pd, on the basis of the image signal Din or Dout (Step S104). In an exemplary embodiment, the controller 20 may cause the potential difference ΔV to be less than the default potential difference ΔVo on the basis of the image signal Din or Dout. In another embodiment, the controller 20 may cause the power voltage Vcc to be less than the default power Vcc_ref on the basis of the image signal Din or Dout. In still another embodiment, the controller 20 may cause the cathode voltage Vcath to be greater than the default cathode voltage Vcath_ref on the basis of the image signal Din or Dout. Additionally, the duty ratio calculator 24 in the controller 20 may cause the duty ratio D to be greater than the default duty ratio Dref on the basis of the image signal Din or Dout. For example, the controller 20 may control the duty ratio D within a range in which the power consumption per frame image on the display panel 10 does not exceed the reference power consumption.

In a case where the ACL exceeds the limit value, the controller 20 may perform the ABL operation and calculate the image signal Dout by multiplying the image signal Din by the gain G (i.e., Din×G) (Step S105). FIG. 4 illustrates an exemplary condition where the gain G is set to 0.5. The controller 20 thereafter dynamically control the potential difference ΔV, the power voltage Vcc, or the cathode voltage Vcath, and the duty ratio D of the voltage pulse Pd on the basis of the image signal Dout (Step S104). In an exemplary embodiment, the controller 20 may cause the potential difference ΔV to be less than the default potential difference ΔVo on the basis of the image signal Dout. In another embodiment, the controller 20 may cause the power voltage Vcc to be less than the default power voltage Vcc_ref on the basis of the image signal Dout. In still another embodiment, the controller 20 may cause the cathode voltage Vcath to be greater than the default cathode voltage Vcath_ref on the basis of the image signal Dout. Additionally, the duty ratio calculator 24 in the controller 20 may cause the duty ratio D to be greater than the default duty ratio Dref on the basis of the image signal Dout. For example, the controller 20 may control the duty ratio D within a range in which the power consumption per frame image on the display panel 10 does not exceed the reference power consumption.

The timing controller 25 will now be described in detail. The timing controller 25 may generate a timing control signal Tout on the basis of the synchronizing signal Tin, and transmit the generated timing control signal Tout to the driver 30. For example, the timing controller 25 may generate the timing control signal Tout on the basis of the data on the duty ratio D received from the duty ratio calculator 24 and the synchronizing signal Tin, and transmit the generated timing control signal Tout to the driver 30 and the power supply circuit 40. The timing controller 25 may generate a control signal directed to generation of the selection pulse Pw, on the basis of the data on the duty ratio D received from the duty ratio calculator 24 and the synchronizing signal Tin, for example, and output the generated control signal to the write scanner 32. The timing controller 25 may generate the control signal directed to generation of the voltage pulse Pd, on the basis of the data on the duty ratio D received from the duty ratio calculator 24 and the synchronizing signal Tin, for example, and output the generated control signal to the power supply circuit 40.

Effects

Figure 6:
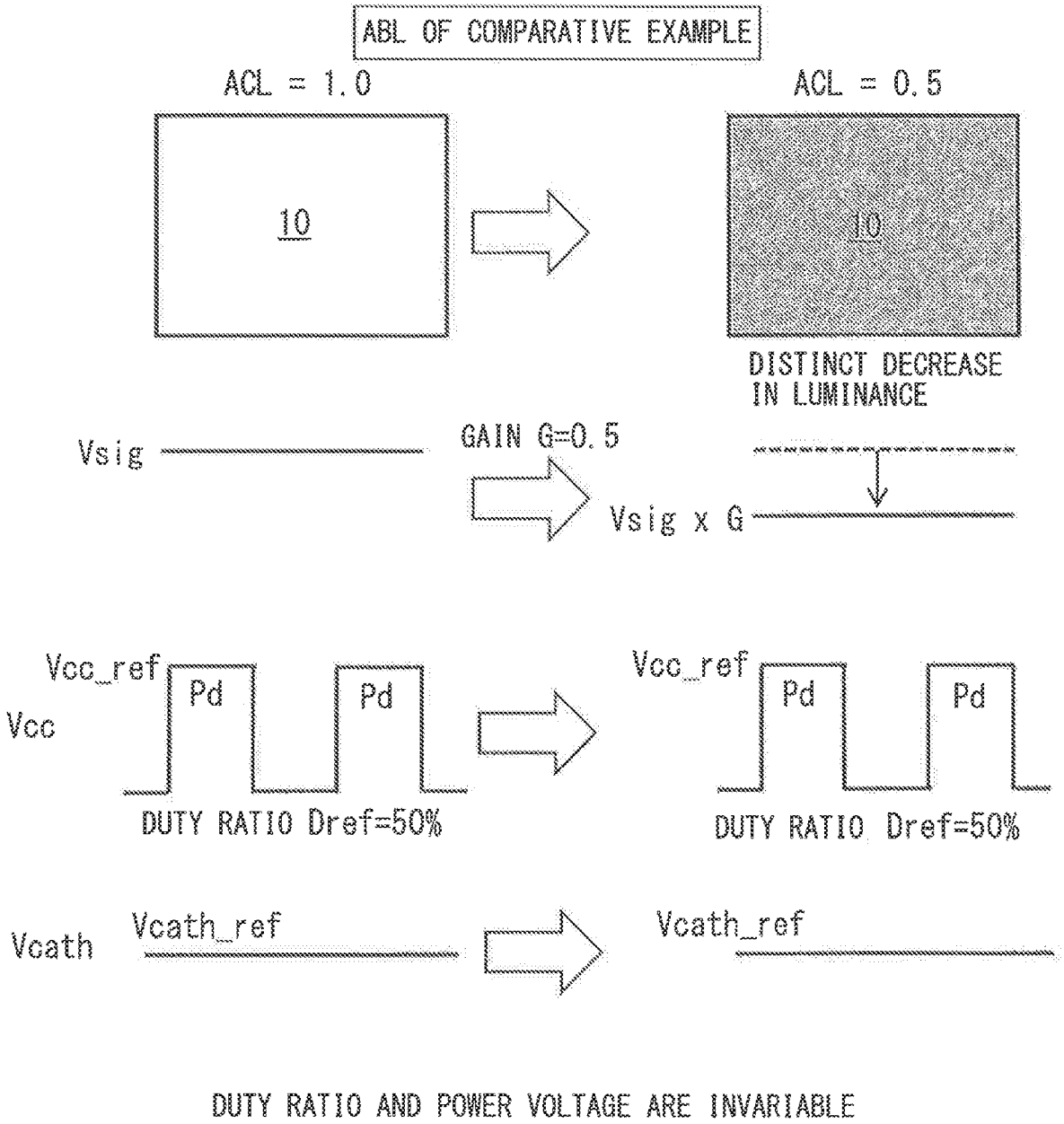
FIG. 6 illustrates example signal processing performed at a controller according to a comparative example.

Some effects of the display unit 1 according to any embodiment of the disclosure will now be described with reference to a comparative example. FIG. 6 illustrates example signal processing performed at a controller according to a comparative example. In the comparative example, only the peak value of the signal voltage is changed using the gain G, and the duty ratio D of the selection pulse, the power voltage Vcc, and the cathode voltage Vcath are constant and invariable regardless of the image signal Dout. In such a case, luminance may possibly be significantly reduced due to the ABL operation.

In contrast, according to any embodiment of the disclosure, the potential difference ΔV between the power voltage Vcc, outputted from the voltage source 40A adjacent to the anode of the organic electroluminescent element 11B, and the cathode voltage Vcath, outputted from the voltage source 40B adjacent to the cathode of the organic electroluminescent element 11B, and the duty ratio D of the voltage pulse Pd are dynamically controlled on the basis of the image signal Din or Dout. Accordingly, it is possible to suppress an increase in power consumption while mitigating or preventing a decrease in luminance.

According to any embodiment of the disclosure, on the basis of the image signal Din or Dout, the potential difference ΔV may be set at a value less than the default potential difference ΔVref, and the duty ratio D may be set at a value greater than the default duty ratio Dref. Accordingly, it is possible to suppress an increase in power consumption while mitigating or preventing a decrease in luminance.

According to any embodiment of the disclosure, the duty ratio D may be controlled within a range in which the power consumption per frame image on the display panel 10 does not exceed the reference power consumption. Accordingly, it is possible to suppress an increase in power consumption while mitigating or preventing a decrease in luminance.

According to any embodiment of the disclosure, the voltage pulse pd that has the duty ratio Dact and of which peak value is the potential difference ΔV adjusted on the basis of the image signal Din may be applied to the current path Pi including the driving transistor Tr1 and the organic electroluminescent element 11B. Accordingly, it is possible to suppress an increase in power consumption while mitigating or preventing a decrease in luminance.

According to any embodiment of the disclosure, the potential difference ΔV and the duty ratio D may be dynamically controlled after the ABL operation. Accordingly, it is possible to suppress an increase in power consumption while mitigating or preventing a decrease in luminance by using a current margin generated through the ABL operation.

2. Modification Examples

One modification example of the display unit 1 according to any embodiment of the disclosure will now be described.

Figure 7:
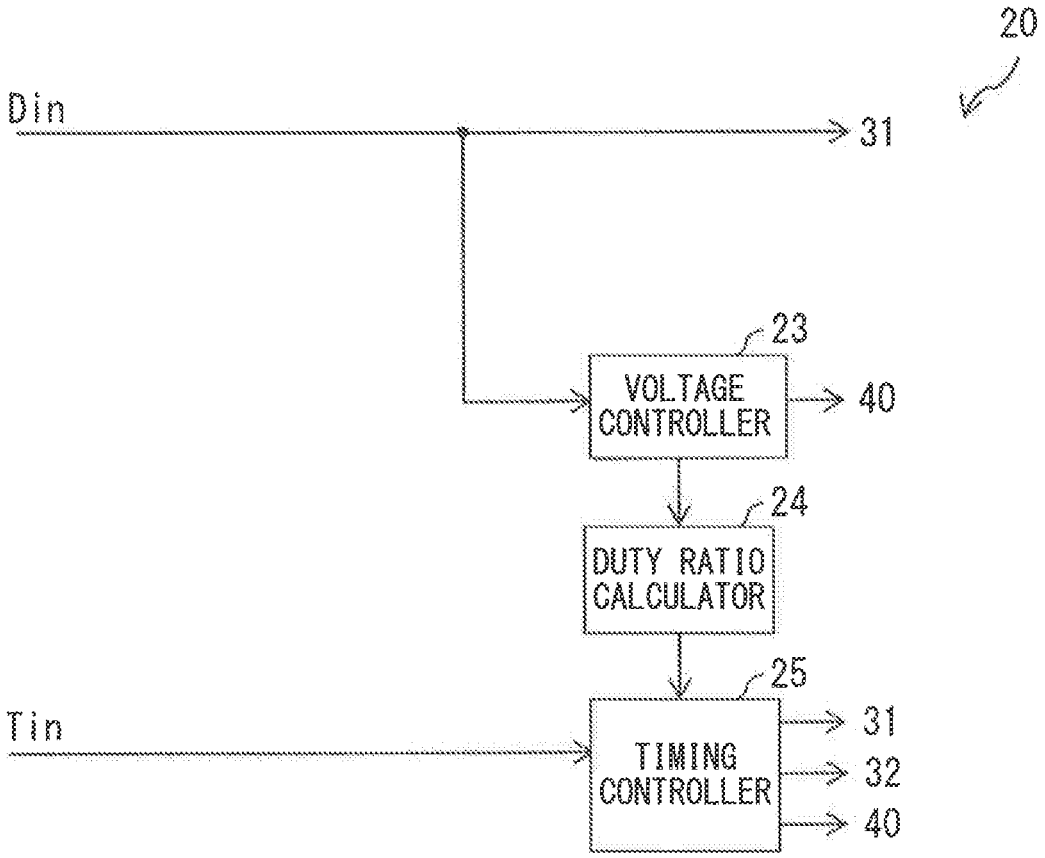
FIG. 7 is an exemplary block diagram illustrating an operation of a controller according to one modification example.

Although the gain calculator 21 and the multiplier 22 that perform the ABL operation may be provided in any embodiment of the disclosure, the gain calculator 21 and the multiplier 22 may be omitted, as illustrated in FIG. 7, for example. Such a modification allows for higher luminance without increasing power consumption.

Furthermore, the technology encompasses any possible combination of some or all of the various embodiments and the modifications described herein and incorporated herein. It is possible to achieve at least the following configurations from the above-described example embodiments of the technology.

Moreover, the disclosure may have the following configurations, for example.

(1) A luminance controlling unit including:

a luminance controller that controls luminance of a pixel array, the pixel array including pixels each including a current-driven self-luminescent element, the luminance controller performing, on a basis of an image signal, a dynamic control of a duty ratio of a voltage pulse and a potential difference between a first voltage and a second voltage, the first voltage being outputted from a first voltage source adjacent to an anode of the corresponding self-luminescent element, the second voltage being outputted from a second voltage source adjacent to a cathode of the corresponding self-luminescent element, the duty ratio being directed to controlling of light emission and light extinction of the self-luminescent element.

(2) The luminance controlling unit according to (1), in which the luminance controller causes, on the basis of the image signal, the potential difference to be less than a default potential difference, and causes the duty ratio to be greater than a default duty ratio.

(3) The luminance controlling unit according to (2), in which the luminance controller controls the duty ratio within a range in which a power consumption per frame image in the pixel array does not exceed a reference power consumption per frame image.

(4) The luminance controlling unit according to (1) or (2), in which each of the pixels includes the self-luminescent element, a driving transistor that controls a driving current flowing in the self-luminescent element, and a switching transistor that writes a signal voltage based on the image signal into a gate of the driving transistor, and the luminance controller applies, to a current path including the driving transistor and the self-luminescent element, the voltage pulse that has the duty ratio and of which peak value is the potential difference.

(5) The luminance controlling unit according to (4), in which the luminance controller performs the dynamic control of the potential difference and the duty ratio after an automatic brightness limiting operation, the automatic brightness limiting operation limiting the driving current by correcting the image signal to cause the signal voltage to be less than the signal voltage based on the image signal.

(6) The luminance controlling unit according to (5), in which the luminance controller controls the duty ratio within a range in which a power consumption per frame image in the pixel array does not exceed a reference power consumption per frame image, the reference power consumption being a power consumption in a condition where the automatic brightness limiting operation is not performed.

(7) A light-emitting unit including:

a pixel array that includes pixels each including a current-driven self-luminescent element; and a luminance controller that controls luminance of the pixel array, the luminance controller performing, on a basis of an image signal, a dynamic control of a duty ratio of a voltage pulse and a potential difference between a first voltage and a second voltage, the first voltage being outputted from a first voltage source adjacent to an anode of the corresponding self-luminescent element, the second voltage being outputted from a second voltage source adjacent to a cathode of the corresponding self-luminescent element, the duty ratio being directed to controlling of light emission and light extinction of the self-luminescent element.

(8) A luminance controlling method including:

controlling luminance of a pixel array, the pixel array including pixels each including a current-driven self-luminescent element; and dynamically controlling a duty ratio of a voltage pulse and a potential difference between a first voltage and a second voltage on a basis of an image signal, the first voltage being outputted from a first voltage source adjacent to an anode of the corresponding self-luminescent element, the second voltage being outputted from a second voltage source adjacent to a cathode of the corresponding self-luminescent element, the duty ratio being directed to controlling of light emission and light extinction of the self-luminescent element.

According to the luminance controlling unit, the light-emitting unit, and the method of controlling luminance according to any embodiment of the disclosure, the potential difference and the duty ratio are dynamically controlled on the basis of the image signal. Accordingly, it is possible to suppress an increase in power consumption while mitigating or preventing a decrease in luminance.

It should be understood that the effects described hereinabove are mere examples. The effects according to an embodiment of the disclosure are not limited to those described hereinabove. The disclosure may further include other effects in addition to the effects described hereinabove.

Although the disclosure has been described in terms of exemplary embodiments, it is not limited thereto. It should be appreciated that variations may be made in the described embodiments by persons skilled in the art without departing from the scope of the disclosure as defined by the following claims. Effects of the disclosure are not limited to those described hereinabove, and may be other effect than those described herein. The limitations in the claims are to be interpreted broadly based on the language employed in the claims and not limited to examples described in this specification or during the prosecution of the application, and the examples are to be construed as non-exclusive. For example, in this disclosure, the use of the terms first, second, etc. do not denote any order or importance, but rather the terms first, second, etc. are used to distinguish one element from another. Moreover, no element or component in this disclosure is intended to be dedicated to the public regardless of whether the element or component is explicitly recited in the following claims.

What is claimed is:

1. A luminance controlling unit comprising:

a luminance controller that controls luminance of a pixel array, the pixel array including pixels each including a current-driven self-luminescent element, the luminance controller performing, on a basis of an image signal, a dynamic control of a duty ratio of a voltage pulse that is output by a first voltage source and a potential difference between the voltage pulse and a second voltage that is output by a second voltage source that is different from the first voltage source, the duty ratio being directed to controlling of light emission and light extinction of the current-driven self-luminescent element, wherein the luminance controller causes, on the basis of the image signal, the potential difference to be less than a default potential difference, and causes the duty ratio to be greater than a default duty ratio, wherein the default duty ratio is an initial duty ratio of the voltage pulse that is output by the first voltage source, wherein, to perform the dynamic control of the duty ratio of the voltage pulse that is output by the first voltage source and the potential difference between the voltage pulse and the second voltage, the luminance controller is further configured to determine a corrected duty ratio, wherein the corrected duty ratio is the default duty ratio multiplied by a compensation factor, wherein the compensation factor is based on the default potential difference divided by a third potential difference, the default potential difference is between a default output voltage of the first voltage source and a default output voltage of the second voltage source, and the third potential difference is between a corrected output voltage of the first voltage source and the default output voltage of the second voltage source, and wherein the compensation factor is less than or equal to 100 divided by the default duty ratio.

2. The luminance controlling unit according to claim 1, wherein the luminance controller controls the duty ratio within a range in which a power consumption per frame image in the pixel array does not exceed a reference power consumption per frame image.

3. The luminance controlling unit according to claim 1, wherein each of the pixels includes the current-driven self-luminescent element, a driving transistor that controls a driving current flowing in the current-driven self-luminescent element, and a switching transistor that writes a signal voltage based on the image signal into a gate of the driving transistor, and the luminance controller applies, to a current path including the driving transistor and the current-driven self-luminescent element, the voltage pulse that has the duty ratio that is greater than the default duty ratio and of which peak value is the potential difference.

4. The luminance controlling unit according to claim 3, wherein the luminance controller performs the dynamic control of the potential difference and the duty ratio after an automatic brightness limiting operation, the automatic brightness limiting operation limiting the driving current by correcting the image signal to cause the signal voltage to be less than the signal voltage based on the image signal.

5. The luminance controlling unit according to claim 4, wherein the luminance controller controls the duty ratio within a range in which a power consumption per frame image in the pixel array does not exceed a reference power consumption per frame image, the reference power consumption being a power consumption in a condition where the automatic brightness limiting operation is not performed.

6. A light-emitting unit comprising:

a pixel array that includes pixels each including a current-driven self-luminescent element; and a luminance controller that controls luminance of the pixel array, the luminance controller performing, on a basis of an image signal, a dynamic control of a duty ratio of a voltage pulse that is output by a first voltage source and a potential difference between the voltage pulse and a second voltage that is output by a second voltage source that is different from the first voltage source, the duty ratio being directed to controlling of light emission and light extinction of the current-driven self-luminescent element, wherein the luminance controller causes, on the basis of the image signal, the potential difference to be less than a default potential difference, and causes the duty ratio to be greater than a default duty ratio, wherein the default duty ratio is an initial duty ratio of the voltage pulse that is output by the first voltage source, wherein, to perform the dynamic control of the duty ratio of the voltage pulse that is output by the first voltage source and the potential difference between the voltage pulse and the second voltage, the luminance controller is further configured to determine a corrected duty ratio, wherein the corrected duty ratio is the default duty ratio multiplied by a compensation factor, wherein the compensation factor is based on the default potential difference divided by a third potential difference, the default potential difference is between a default output voltage of the first voltage source and a default output voltage of the second voltage source, and the third potential difference is between a corrected output voltage of the first voltage source and the default output voltage of the second voltage source, and wherein the compensation factor is less than or equal to 100 divided by the default duty ratio.

7. A luminance controlling method comprising:

controlling, with a luminance controller, a luminance of a pixel array, the pixel array including pixels each including a current-driven self-luminescent element; and dynamically controlling, on a basis of an image signal and with the luminance controller, a duty ratio of a voltage pulse that is output by a first voltage source and a potential difference between the voltage pulse and a second voltage that is output by a second voltage source that is different from the first voltage source, the duty ratio being directed to controlling of light emission and light extinction of the current-driven self-luminescent element, wherein dynamically controlling the duty ratio of the voltage pulse that is output by the first voltage source and the potential difference between the voltage pulse and the second voltage on the basis of the image signal further includes causing, on the basis of the image signal, the potential difference to be less than a default potential difference and the duty ratio to be greater than a default duty ratio, wherein the default duty ratio is an initial duty ratio of the voltage pulse that is output by the first voltage source, wherein dynamically controlling the duty ratio of the voltage pulse that is output by the first voltage source and the potential difference between the voltage pulse and the second voltage further includes determining a corrected duty ratio, wherein the corrected duty ratio is the default duty ratio multiplied by a compensation factor, wherein the compensation factor is based on the default potential difference divided by a third potential difference, the default potential difference is between a default output voltage of the first voltage source and a default output voltage of the second voltage source, and the third potential difference is between a corrected output voltage of the first voltage source and the default output voltage of the second voltage source, and wherein the compensation factor is less than or equal to 100 divided by the default duty ratio.

8. The luminance controlling method according to claim 7, wherein dynamically controlling the duty ratio of the voltage pulse that is output by the first voltage source and the potential difference between the voltage pulse and the second voltage on the basis of the image signal further includes controlling the duty ratio within a range in which a power consumption per frame image in the pixel array does not exceed a reference power consumption per frame image.

9. The luminance controlling method according to claim 7, wherein each of the pixels includes the current-driven self-luminescent element, a driving transistor that controls a driving current flowing in the current-driven self-luminescent element, and a switching transistor that writes a signal voltage based on the image signal into a gate of the driving transistor, and the luminance controlling method further comprising:

applying, with the luminance controller, the voltage pulse that has the duty ratio that is greater than the default duty ratio and of which peak value is the potential difference to a current path including the driving transistor and the current-driven self-luminescent element.

10. The luminance controlling method according to claim 9, further comprising:

performing, with the luminance controller, an automatic brightness limiting operation that limits the driving current by correcting the image signal to cause the signal voltage to be less than the signal voltage based on the image signal; and responsive to performing the automatic brightness limiting operation, the luminance controller performs the dynamic control of the potential difference and the duty ratio.

11. The luminance controlling method according to claim 10, wherein dynamically controlling the duty ratio of the voltage pulse that is output by the first voltage source and the potential difference between the voltage pulse and the second voltage on the basis of the image signal further includes controlling the duty ratio within a range in which a power consumption per frame image in the pixel array does not exceed a reference power consumption per frame image, the reference power consumption being a power consumption in a condition where the automatic brightness limiting operation is not performed.

12. The luminance controlling method according to claim 7, wherein the potential difference that is dynamically controlled is always less than or equal to the default potential difference, and wherein the duty ratio that is dynamically controlled is always greater than or equal to the default duty ratio.

13. The light-emitting unit according to claim 6, wherein the luminance controller controls the duty ratio within a range in which a power consumption per frame image in the pixel array does not exceed a reference power consumption per frame image.

14. The light-emitting unit according to claim 6, wherein each of the pixels includes the current-driven self-luminescent element, a driving transistor that controls a driving current flowing in the current-driven self-luminescent element, and a switching transistor that writes a signal voltage based on the image signal into a gate of the driving transistor, and the luminance controller applies, to a current path including the driving transistor and the current-driven self-luminescent element, the voltage pulse that has the duty ratio that is greater than the default duty ratio and of which peak value is the potential difference.

15. The light-emitting unit according to claim 14, wherein the luminance controller performs the dynamic control of the potential difference and the duty ratio after an automatic brightness limiting operation, the automatic brightness limiting operation limiting the driving current by correcting the image signal to cause the signal voltage to be less than the signal voltage based on the image signal.

16. The light-emitting unit according to claim 15, wherein the luminance controller controls the duty ratio within a range in which a power consumption per frame image in the pixel array does not exceed a reference power consumption per frame image, the reference power consumption being a power consumption in a condition where the automatic brightness limiting operation is not performed.

17. The light-emitting unit according to claim 6, wherein the potential difference that is dynamically controlled is always less than or equal to the default potential difference, and wherein the duty ratio that is dynamically controlled is always greater than or equal to the default duty ratio.

18. The luminance controlling unit according to claim 1, wherein the potential difference that is dynamically controlled is always less than or equal to the default potential difference, and wherein the duty ratio that is dynamically controlled is always greater than or equal to the default duty ratio.

* * * * *